United States Patent [19]

Shirai

[11] Patent Number: 4,775,606

[45] Date of Patent: Oct. 4, 1988

[54] LIGHT RECEIVING MEMBER COMPRISING AMORPHOUS SILICON LAYERS FOR ELECTROPHOTOGRAPHY

[75] Inventor: Shigeru Shirai, Ueno, Japan

[73] Assignee: Canon Kabushiki Kaisha, Tokyo, Japan

[21] Appl. No.: 941,429

[22] Filed: Dec. 15, 1986

[30] Foreign Application Priority Data

Dec. 17, 1985 [JP] Japan ..... 60-282013

[51] Int. Cl.[4] ..... G03G 5/14

[52] U.S. Cl. ..... 430/67; 430/57

[58] Field of Search ..... 430/57, 66, 67

[56] References Cited

U.S. PATENT DOCUMENTS

| | | | |
|---|---|---|---|
| 4,613,556 | 9/1986 | Mort et al. | 430/84 |
| 4,661,427 | 4/1987 | Kanai | 430/66 X |
| 4,663,258 | 5/1987 | Pai et al. | 430/66 X |

*Primary Examiner*—J. David Welsh

*Attorney, Agent, or Firm*—Fitzpatrick, Cella, Harper & Scinto

[57] ABSTRACT

There is provided an improved light receiving member comprising a substrate for electrophotography and a light receiving layer being formed of a first layer composed of an amorphous material containing silicon atoms as the main component and an element for controlling the conductivity, a second layer having a photoconductivity composed of an amorphous material containing silicon atoms as the main component and a third layer composed of an amorphous material containing silicon atoms as the main component and carbon atoms, said third layer being a two-layer structure having a lower layer region of 0.05 to 0.2 $\mu$m in thickness with a defect density of less than $8\times10^{18}$ $cm^{-3}$ (ESR signal) and an upper layer region with a defect density of more than $8\times10^{18}$ $cm^{-3}$ (ESR signal) and a volume resistivity of more than $5\times10^{12}$ $\Omega$.cm.

8 Claims, 3 Drawing Sheets

LIGHT RECEIVING MEMBER COMPRISING AMORPHOUS SILICON LAYERS FOR ELECTROPHOTOGRAPHY

FIELD OF THE INVENTION

This invention relates to light receiving members sensitive to electromagnetic waves such as light (which herein means in a broader sense those lights such as ultra-violet rays, visible rays, infrared rays, X-rays and γ-rays).

BACKGROUND OF THE INVENTION

For the photoconductive materials to constitute an image-forming member for use in solid image pickup device or electrophotography, or to constitute a photoconductive layer for use in image-reading photosensor, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon the use.

Others than these requirements, it is required to have a property to remove a residual image within a predetermined period of time in solid image pickup device.

Particularly for the image-forming member for use in an electrophotographic machine which is daily used as a business machine at office, causing no pollution is indeed important.

From these standpoints, the public attention has been focused on light receiving members comprising amorphous materials containing silicon atoms (hereinafter referred to as "a-Si"), for example, as disclosed in Offenlegungsschriftes Nos. 2746967 and 2855718 which disclose use of the light receiving member as an image-forming member in electrophotography and in Offenlegungsschrift No. 2933411 which discloses use of the light receiving member in an image-reading photosensor.

For the conventional light receiving members comprising a-Si materials, there have been made improvements in their optical, electric and photoconductive characteristics such as dark resistance, photosensitivity, and photoresponsiveness, use-environmental characteristics, economic stability and durability.

However, there are still left subjects to make further improvements in their characteristics in the synthesis situation in order to make such light receiving member practically usable.

For example, in the case where such conventional light receiving member is used as an image-forming member in electrophotography with aiming at heightening the photosensitivity and dark resistance, there are often observed a residual voltage on the conventional light receiving member upon the use, and when it is repeatedly used for a long period of time, fatigues due to the repeated use will be accumulated to cause the so-called ghost phenomena inviting residual images.

Further, in the preparation of the conventional light receiving member using an a-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in a light receiving layer of the light receiving member as the layer constituents.

However, the resulting light receiving layer sometime becomes accompanied with defects on the electrical characteristics, photoconductive characteristics and/or breakdown voltage according to the way of the incorporation of said constituents to be employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are likely to appear on the transferred images on a paper sheet.

Further, in the case where the above light receiving member is used in a much moist atmosphere, or in the case where after being placed in that atmosphere it is used, there sometimes appear the so-called "image flow" on the transferred images on a paper sheet.

Further in addition, in the case of forming a light receiving layer of a ten and some mμ in thickness on an appropriate substrate to obtain a light receiving member, the resulting light receiving layer is likely to invite undesired phenomena such as a thinner inbetween space being formed between the bottom face and the surface of the substrate, the layer being removed from the substrate and a crack being generated within the layer following the lapse of time after the light receiving member is taken out from the vacuum deposition chamber.

These phenomena are apt to occur in the case of using a cylindrical substrate to be usually used in the field of electrophotography.

In consequence, it is necessitated not only to make a further improvement in an a-Si material itself but also to establish such a light receiving member not to invite any of the foregoing problems.

SUMMARY OF THE INVENTION

The object of this invention is to provide a light receiving member comprising a light receiving layer mainly composed of a-Si, free from the foregoing problems and capable of satisfying various kind of requirements.

That is, the main object of this invention is to provide a light receiving member comprising a light receiving layer constituted with a-Si in which electrical, optical and photoconductive properties are always substantially stable scarcely depending on the working circumstances, and which is excellent against optical fatigue, causes no degradation upon repeating use, excellent in durability and moisture-proofness, exhibits no or scarce residual voltage and provides easy production control.

Another object of this invention is to provide a light receiving member comprising a light receiving layer composed of a-Si which has high photosensitivity, high S/N ratio and high electrical voltage withstanding property.

Another object of this invention is to provide a light receiving member comprising a light receiving layer composed of a-Si which is excellent in the close bondability between a support and a layer disposed on the support or between each of the laminated layers, dense and stable in view of the structural arrangement and of high layer quality.

A further object of this invention is to provide a light receiving member comprising a light receiving layer composed of a-Si which exhibits a sufficient charge-maintaining function in the electrification process of forming electrostatic latent images and excellent electrophotographic characteristics when it is used in electrophotographic method.

A still further object of this invention is to provide a light receiving member comprising a light receiving layer composed of a-Si which invites neither an image defect nor an image flow on the resulting visible images on a paper sheet upon repeated use in a long period of time and which gives highly resolved visible images with clearer half-tone which are highly dense and quality.

The present inventor has made earnest studies for overcoming the foregoing problems on the conventional light receiving members and attaining the objects as described above and, as a result, has accomplished this invention based on the findings as described below.

As a result of the earnest studies forcusing on materiality and practical applicability of a light receiving member comprising a light receiving layer composed a-Si for use in electrophotography, solid image-pickup device and image-reading device, the present inventor has obtained the following findings.

One of the findings is that in case where the constitution of the light receiving layer is made in the particular way as later described, the resulting light receiving member becomes to bring about many practical applicable excellent characteristics, especially usable for electrophotography, and superior to the conventional light receiving member in any of the requirements.

Another finding is that as it is required for a light receiving member comprising a-Si to have a surface layer serving not only as a covering layer in order to promote humidity resistance, deterioration resistance upon repeating use, breakdown voltage resistance, use-environmental characteristics and durability and at the same time as a charge injection inhibition layer, the layer formed of an a-Si material containing carbon atoms (hereinafter referred to as "a-SiC") satisfies said requirements and can serve as such surface layer satisfactorily.

A further finding is that in case where said layer composed of a-SiC is constituted by a minute structural layer and it is lesser in defect density, the electrification will be increased, but there are disadvantages that it takes much time to form such layer so as to have a layer thickness sufficient enough to effectively bring about the foregoing characteristics and even if a desired layer should be fortuitously formed, it is apt to generate a residual voltage.

A still further finding is that in case where said layer composed of a-Sic is formed to be of a thinner thickness in order to eliminate the problem of said residual voltage, the layer will result in decreasing the durability and bringing about undesired defects on the visible images obtained.

The present inventor has continued further studies on the basis of the above findings, as a result, it has been finally found that in the case where the surface layer composed of a-SiC is formed to have a two-layer structure having a particular lower layer region and a particular upper layer region, the foregoing problems can be effectively solved.

Accordingly, this invention is to provide an improved light receiving member comprising a substrate for electrophotography and a light receiving layer being formed of a first layer composed of an amorphous material containing silicon atoms as the main component and an element for controlling the conductivity, a second layer having a photoconductivity composed of an amorphous material containing silicon atoms as the main component and a third layer composed of an amorphous material containing silicon atoms as the main component and carbon atoms, said third layer being a two-layer structure having a lower layer region of 0.05 to 0.2 $\mu$m in thickness with a defect density of less than $8\times10^{18}$ cm$^{-3}$ (ESR signal) and an upper layer region with a defect density of more than $8\times10^{18}$ cm$^{-3}$ (ESR signal) and a volume resistivity of more than $5\times10^{12}$ Ω.cm.

DETAILED DESCRIPTION OF THE INVENTION

Figure 1:
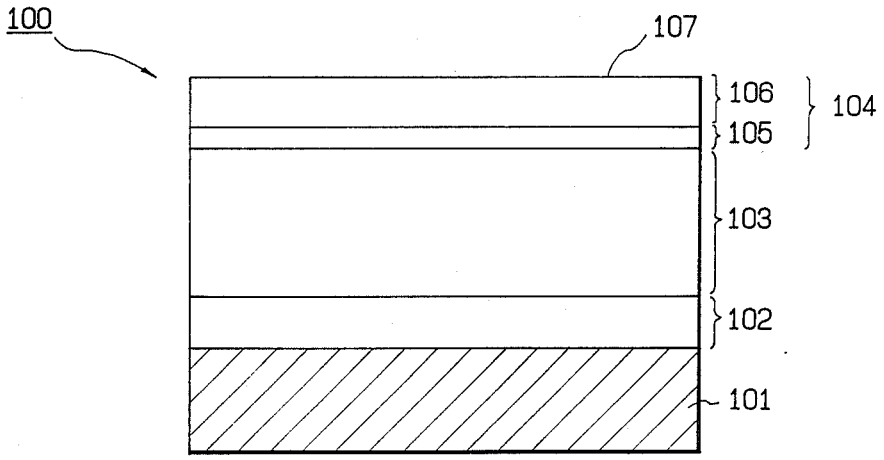
FIG. 1 is a schematic view illustrating the layer constitution of a representative light receiving member according to this invention.

Representative embodiments of the light receiving member according to this invention will now be explained more specifically referring to the drawings. The description is not intended to limit the scope of the invention.

A representative light receiving member of this invention is as shown in FIG. 1, in which is shown a light receiving member 100 comprising substrate 101, first layer 102, second layer 103 and third layer 104 having free surface 107 which is constituted by lower layer region 105 and upper layer region 106.

Substrate 101

The substrate 101 for use in this invention may either be electroconductive or insulative. The electroconductive support can include, for example, metals such as NiCr, stainless steels, Al, Cr, Mo, Au, Nb, Ta, V, Ti Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc, or applying lamination with the metal to the surface. The substrate may be of any configuration such as cylindrical, belt-like or plate-like shape, which can be properly determined depending on the application uses. For instance, in the case of using the light receiving member shown in FIG. 1 as image forming member for use in electronic photography, it is desirably configurated into an endless belt or cylindrical form in the case of continuous high speed reproduction. The thickness of the support member is properly determined so that the light receiving member as desired can be formed. In the case flexibility is required for the light receiving member, it can be made as thin as possible within a range capable of sufficiently providing the function as the substrate. However, the thickness is usually greater than 10 μm in view of the fabrication and handling or mechanical strength of the substrate.

First layer 102

The first layer 102 is disposed on the substrate 101 and is composed of an a-Si material or a hydrogenated a-Si material respectively containing a substance for controlling the conductivity [hereinafter referred to as "a-SiM(H)", in which M stands for a substance for controlling the conductivity].

As the substance for controlling the conductivity, so-called impurities in the field of the semiconductor can be mentioned and those usable herein can include atoms belonging to the group III of the periodical table that provide p-type conductivity (hereinafter simply referred to as "group III atom") or atoms belonging to the group V of the periodical table that provide n-type conductivity (hereinafter simply referred to as "group V atom"). Specifically, the group III atoms can include B (boron), Al (aluminum), Ga (gallium), In (indium) and Ti (thallium), B and Ga being particularly preferred. The group V atoms can include, for example, P (phosphor), As (arsenic), Sb (antimony) and Bi (bismuth), P and Sb being particularly preferred.

Since the first layer 102 contains either the group III atoms or the group V atoms respectively for controlling the conductivity, it serves as a charge injection inhibition layer to inhibit movement of an electric charge injected from the side of the substrate into the light receiving layer and it functions to allow movement of an electric charge generated in the second layer 103 into the substrate 101.

The amount of the group III atoms or the group V atoms to be incorporated in the first layer 102 is preferably $3\times10$ to $5\times10^4$ atomic ppm, more preferably, $5\times10$ to $1\times10^4$ atomic ppm, and most preferably, $1\times10^2$ to $5\times10^3$ atomic ppm.

For hydrogen atoms to be incorporated in the first layer 102 in case where necessary, its amount in that layer is preferably $1\times10^{-2}$ to $4\times10$ atomic %, more preferably, $5\times10^{-2}$ to $3\times10$ atomic %, and most preferably, $1\times10^{-1}$ to 25 atomic %.

The thickness of the first layer 102 is an important factor in order to effectively attain the object of this invention, and it is preferred to be 30 Å to 1000 Å.

Second layer 103

The second layer 103 is disposed on the first layer 102, and it is composed of an a-Si material containing silicon atoms as the main component, and if necessary, hydrogen atoms (H) and/or halogen atoms (X) [hereinafter referred to as "a-Si(H,X)"].

The halogen atom (X) includes, specifically, fluorine, chlorine, bromine and iodine. And among these halogen atoms fluorine and chlorine are particularly preferred. The amount of the hydrogen atoms (H), the amount of the halogen atoms (X) or the sum of the amounts for the hydrogen atoms and the halogen atoms (H+X) to be incorporated in the second layer is preferably $1\times10^{-2}$ to $4\times10$ atomic %, more preferably, $5\times10^{-2}$ to $3\times10$ atomic %, and most preferably, $1\times10^{-1}$ to 25 atomic %.

The thickness of the second layer 103 is an important factor in order to effectively attain the object of this invention, and it is appropriately determined depending upon the desired purpose.

It is, however, also necessary that the layer thickness is determined in view of relative and organic relationships in accordance with the amounts of the halogen atoms and hydrogen atoms contained in the layer or the characteristics required in the relationship with the thickness of other layer. Further, it should be determined also in economical point of view such as productivity or mass productivity. In view of the above, the thickness of the second layer 103 is preferably 1 to 100 μm, more preferably, 1 to 80 μm, and, most preferably, 2 to 50 μm.

Third layer 104

The third layer (surface layer) 104 serves to promote humidity resistance, deterioration resistance upon repeating use, breakdown voltage resistance, use-environmental characteristics and durability of the light receiving member of this invention, and it functions to inhibit a charge injection into the light receiving layer from the side of the free surface 107.

the third layer 104 has a two-layer structure composed of an a-Si material containing carbon atoms (hereinafter referred to as "a-SiC"). That is, the third layer 104 comprises the lower layer region 105 of 0.05 to 0.2 μm in thickness having a defect density of less than $8\times10^{18}$ $cm^{-3}$ (ESR signal) and the upper layer region 106 having a defect density of more than $8\times10^{18}$ $cm^{-3}$ (ESR signal) and a volume resistivity of more than $5\times10^{12}$ Ω.cm.

The amount of carbon atoms to be incorporated in the lower layer region 105 and the upper layer region 106 is preferably $1\times10^{-3}$ to 90 atomic %, more preferably 1 to 90 atomic %, and, most preferably, 10 to 80 atomic % respectively.

As explained above, since the light receiving member of this invention has a surface layer of a particular two-layer structure consisting of the lower layer region 105 composed of a-SiC and the upper layer region 106 composed of a-SiC having a different defect density and a different resistivity one from another and the defect density for the upper layer region is relatively large, movement of an electric charge in some extent becomes possible and a residual voltage will be hardly occurred. In addition, since occurrence of the residual voltage is effectively prevented, it becomes not necessary to make the surface layer (third layer 104) thinner as in the conventional light receiving member, and it is possible to make that layer thicker appropriately in order to raise the characteristics such as durability.

However, it is necessary to make the upper layer region 106 to have a relatively higher electric resistance in view that an image flow will be occurred in the case where the electric resistance is lower.

On the other hand, the lower layer region 105 is constituted by a minute structural layer composed of a-SiC of 0.05 to 20 μm thickness and with a smaller defect density. Because of this, the lower layer region 105 serves to effectively prevent a charge injection from the side of the free surface 107.

Because of having the particular layer constitution as explained above, the light receiving member of this invention exhibits many excellent electric, optical and photoconductive characteristics, excellent breakdown voltage resistance and excellent use-environmental characteristics without accompaniment of any problem found on the conventional light receiving member upon the use.

Particularly, in the case of applying the light receiving member to the electrophotography, it gives no undesired effects at all of the residual voltage to the image formation, stable electrical properties high sensitivity and high S/N ratio, excellent light fastness and property for repeating use, high image density and clear half tone and can provide high quality image with high resolution power repeatingly.

The method of forming the light receiving layer of the light receiving member will be now explained.

Each of the first layer 102, the second layer 103 and the third layer 104 to constitute the light receiving layer of the light receiving member of this invention is properly prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the light receiving members having desired properties are relatively easy and carbon atoms and hydrogen atoms can be introduced easily together with silicon atoms. The glow discharging method and the sputtering method may be used together in one identical system.

Basically, when a layer constituted with a-Si(H,X) is formed, for example, by the glow discharging method, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of a-Si(H,X) is formed on the surface of a predetermined substrate disposed previously at a predetermined position.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$. The use of the gaseous or gasifiable silicon halide as described above is particularly advantageous since the layer constituted with halogen atom-containing a-Si can be formed with no additional use of the gaseous starting material for supplying Si.

The gaseous starting material usable for supplying hydrogen atoms can include those gaseous or gasifiable materials, for example, hydrogen gas, halides such as HF, HCl, HBr, and HI, silicon hydrides such as $SiH_4$, $Si_2H_6$, $Si_3H_8$, and $Si_4H_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms (H), which are extremely effective in view of the control for the electrical or photoelectronic properties, can be controlled with ease. Then, the use of the hydrogen halide or the halogen-substituted silicon hydride as described above is particularly advantageous since the hydrogen atoms (H) are also introduced together with the introduction of the halogen atoms.

The amount of the hydrogen atoms (H), the amount of the halogen atoms (X) or the sum of the amounts for the hydrogen atoms and the halogen atoms (H+X) is preferably from 0.01 to 40 atomic %, preferably, from 0.05 to 30 atomic %, and, most preferably from 0.1 to 25 atomic %.

The amount of the hydrogen atoms (H) and/or the amount of the halogen atoms (X) to be contained in a layer are adjusted properly by controlling related conditions, for example, the temperature of a substrate, the amount of a gaseous starting material capable of supplying the hydrogen atoms or the halogen atoms into a deposition chamber and the electric discharging power.

Now, in the case of forming a layer composed of a-Si(H,X) by the reactive sputtering process, the layer is formed on the substrate by using an Si target and sputtering the Si target in a plasma atmosphere.

To form said layer by the ion-plating process, the vapor of silicon is allowed to pass through a desired gas plasma atmosphere.

The silicon vapor is produced by heating polycrystal silicon or single crystal silicon held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced.

In the case where the layer is incorporated with hydrogen atoms, a feed gas to liberate hydrogen is introduced into the deposition chamber in which a plasma atmosphere of the gas is produced. The feed gas to liberate halogen atoms includes the above-mentioned halogen-containing silicon compounds.

For example, in the case of the reactive sputtering process, the layer composed of a-Si(H,X) is formed on the substrate by using an Si target and by introducing a halogen atom introducing gas and $H_2$ gas, if necessary, together with an inert gas such as He or Ar into a deposition chamber to thereby form a plasma atmosphere and then sputtering the Si target.

In order to form a layer constituted with an amorphous material composed of a-Si(H,X) further incorporated with the group III atoms or the group V atoms using a glow discharging, sputtering or ion plating process, the starting material for introducing the group III or group V atoms is used together with the starting material for forming a-Si(H,X) upon forming the a-Si(H,X) layer while controlling the amount of them in the layer to be formed.

For instance, in the case of forming the first layer 102 constituted with a-Si (H) containing the group III or group V atoms, namely a-SiM(H), by using the glow discharging, the starting gases material for forming the a-SiM(H) are introduced into a deposition chamber in which a substrate being placed, optionally being mixed with an inert gas such as Ar or He in a predetermined mixing ratio, and the thus introduced gases are exposed to the action of glow discharge to thereby cause a gas plasma resulting in forming a layer composed of a-SiM(H) to be the first layer 102 on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically to, the phosphor atom introducing materials, they can include, for example, phosphor hydrides such as $PH_3$ and $P_2H_6$ and phosphor halide such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned to as the effective starting material for introducing the group V atoms.

In order to form the third layer (surface layer) 104 using the glow discharging process, the starting gaseous material, optionally, being mixed with an inert gas such as Ar or He in a predetermined mixing ratio, is introduced into a deposition chamber wherein the substrate already having the first layer 102 and the second layer 103 thereon being placed and the thus introduced gases are exposed to the action of glow discharge to thereby cause a gas plasma resulting in forming a layer composed of a-SiC to be the third layer 104 on the previously deposited second layer.

As the starting gaseous material for forming a layer composed of a-SiC, a gaseous material comprising silicon atoms (Si) and carbon atoms (C) as the constituent atoms or a mixture of gaseous starting material comprising silicon atoms (Si) as the constituent atoms and gaseous starting material comprising carbon atoms (C) as the constituent atoms in a desired mixing ratio are optionally used.

Those gaseous starting materials that are effectively usable herein can include gaseous silicon hydrides comprising C and H as the constituent atoms, such as silanes, for example, $SiH_4$, $Si_2H_6$, $Si_3H_8$ and $Si_4H_{10}$, as well as those comprising C and H as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene $C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material comprising Si, C and H as the constituent atoms can include silicified alkyls, for example, $Si(CH_3)_4$ and $Si(C_2H_5)_4$. In addition to these gaseous starting materials, $H_2$ can of course be used as the gaseous starting material for introducing H.

In the case of forming the third layer 104 composed of a-SiC by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, gaseous starting material for introducing carbon atoms is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

In the preparation of the light receiving member of this invention by the glow discharge process, sputtering process or ion plating poocess, the amount of the group III atoms or the group V atoms in the light receiving layer composed of a-Si(H,X) is controlled by regulating the gas flow rate, the gas flow ratio, the temperature of the substrate, electric discharging power or the vacuum in the deposition chamber.

The temperature of the support is usually from 50° to 350° C. and, more preferably, from 50° to 250° C.; the gas pressure in the deposition chamber is usually from 0.01 to 1 Torr and, particularly preferably, from 0.1 to 0.5 Torr; and the electrical discharging power is usually from 0.005 to 50 W/cm$^2$, more preferably, from 0.01 to 30 W/cm$^2$ and, particularly preferably, from 0.01 to 20 W/cm$^2$.

However, the actual conditions for forming the layer such as temperature of the support, discharging power and the gas pressure in the deposition chamber cannot usually be determined with ease independent of each other. Accordingly, the conditions optimal to the layer formation are desirably determined based on relative and organic relationships for forming the amorphous material layer having desired properties.

DESCRIPTION OF THE PREFERRED EMBODIMENTS

The invention will be described more specifically while referring to Examples 1 through 4, but the invention is no way limited only to these Examples.

In each of the Examples, the light receiving layer was formed by using the glow discharging process.

Gas reservoirs 202, 203, 204, 205, and 206 illustrated in the figure are charged with gaseous starting materials for forming the respective layers in this invention, that is, for instance, $SiH_4$ gas (99.999% purity) diluted with He (hereinafter referred to as "$SiH_4$/He gas") in the reservoir 202, $PH_3$ gas (99.999% purity) diluted with He (hereinafter referred to as "$PH_3$/He gas") in the reservoir 203, $B_2H_6$ gas (99.999% purity) diluted with He (hereinafter referred to as "$B_2H_6$/He gas") in the reservoir 204, $H_2$ gas (99.999% purity) in the gas reservoir 205 and $CH_4$ gas in the gas reservoir 206.

In the case for introducing halogen atoms (X) into a layer, the reservoir for $SiH_4$ is replaced by another reservoir for $SiF_4$ gas for instance.

Prior to the entrance of these gases into a reaction chamber 201, it is confirmed that valves 222–226 for the gas reservoirs 202–206 and a leak valve 235 are closed and that inlet valves 212–216, exit valves 217–221, and sub-valves 232 and 233 are opened. Then, a main valve 234 is at first opened to evacuate the inside of the reaction chamber 201 and gas piping.

Then, upon observing that the reading on the vacuum 236 became about $5\times10^{-6}$ Torr, the sub-valves 232 and 233 and the exit valves 217–221 are closed.

Now, reference is made to an example in the case of forming a light receiving layer on an Al cylinder as a substrate 237.

$SiH_4$/He gas from the gas reservoir 202, $B_2H_6$/He gas from the gas reservoir 204 and $H_2$gas from the gas reservoir 205 are caused to flow into mass flow controllers 207, 209, and 210 respectively by opening the inlet valves 212, 214, and 215, controlling the pressure of exit pressure gauges 227, 229, and 230 to 1 kg/cm$^2$. Subsequently, the exit valves 217, 219, and 220, and the sub-valve 232 are gradually opened to enter the gases into the reaction chamber 201.

In this case, the exit valves 217, 219 and 220 are adjusted so as to attain a desired value for the ratio among the $SiH_4$/He gas flow rate, the $B_2H_6$/He gas flow rate, and the $H_2$ gas flow rate, and the opening of the main valve 234 is adjusted while observing the reading on the vacuum gauge 236 so as to obtain a desired value for the pressure inside the reaction chamber 201. Then, after confirming that the temperature of the Al cylinder 237 has been set by a heater 238 within a range from 50° to 400° C., a power source 240 is set to a predetermined electrical power to cause glow discharging in the reaction chamber 201 while controlling the above gas flow rates to thereby form a layer containing boron atoms and hydrogen atoms to be the first layer 102.

After a predetermined period of time, closing the exit valve 219 for the $B_2H_6$/He gas, the film forming process is continued to form the second layer 103 on the first layer 102.

In the case where introducing halogen atoms into the second layer is desired, $SiF_4$/He gas, for instance, is further introduced into the reaction chamber 201.

In order to form a layer composed of a-SiC to be the third layer 104 on the already formed second layer, operating the corresponding valves in the same way as in the case of forming the first layer or the second layer, $SiH_4$ gas, $CH_4$ gas and $H_2$, if necessary, being diluted with a diluting gas are introduced into the reaction chamber 201 respectively at a predetermined flow rate while causing glow discharging under predetermined conditions to thereby form a layer composed of a-SiC to be the lower layer region 105, generally, at a relatively lower film forming rate. Then, a successive layer composed of a-SiC to be the upper layer region 106 is formed on the previous layer.

All of the exit valves other than those required for upon forming the respective layers are of course closed. Further, upon forming the respective layers, the inside of the system is once evacuated to a high vacuum degree as required by closing the exit valves 217–221 while opening the sub-valves 232 and 233 and fully opening the main valve 234 for avoiding that the gases having been used for forming the previous layer are left in the reaction chamber 201 and in the gas pipeways from the exit valves 217–221 to the inside of the reaction chamber 201.

Further, during the film formation process for the respective layers, the substrate 237 is rotated at a predetermined rotation speed by operating motor 239 in order to attain the uniformness of the layer to be formed.

EXAMPLE 1

In this example, layers respectively composed of an amorphous material containing carbon atoms to constitute the third layer 104 respectively were prepared in accordance with the conditions A through E shown in Table 1 below shown. The state density (ESR) and volume resistivity were measured for each of the layers. The results are shown in the Table 1.

Figure 2:
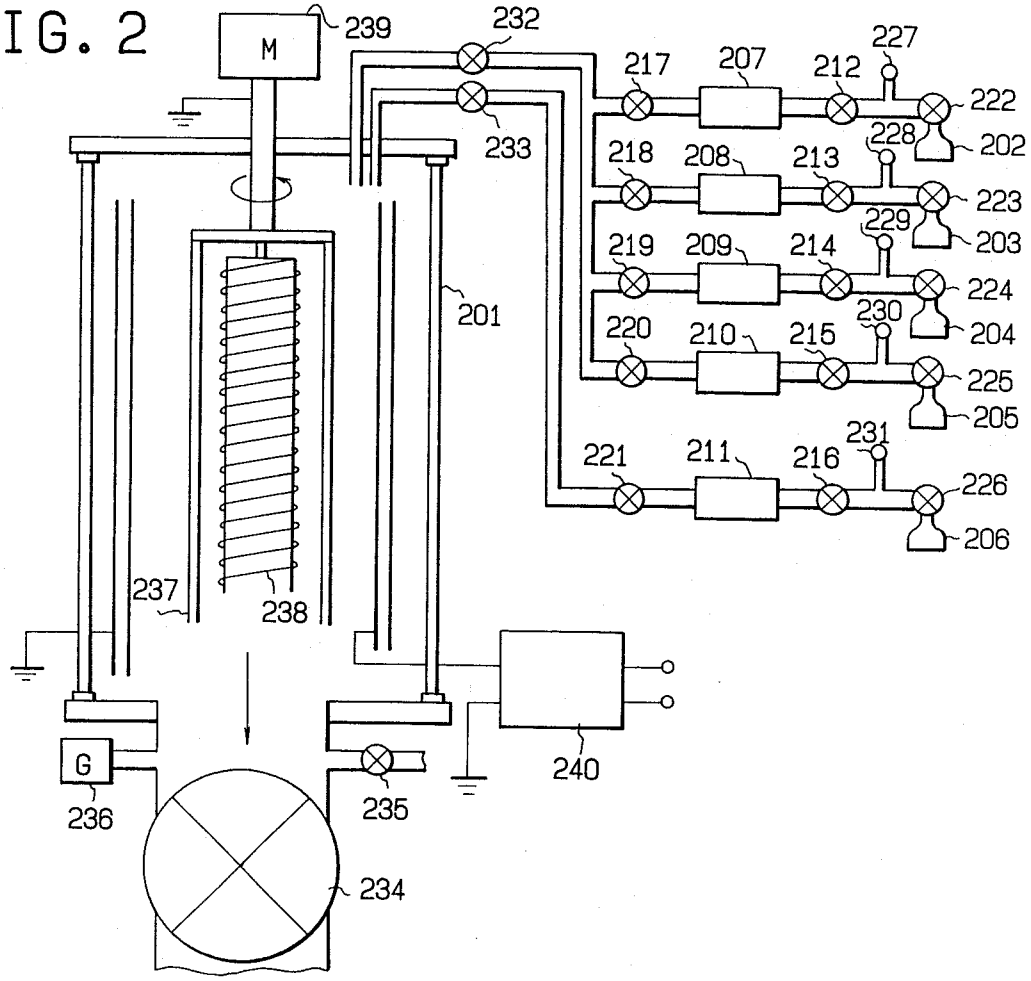
FIG. 2 is a schematic explanatory view of a fabrication apparatus for preparing the light receving member according to this invention.

A light receiving layer constituted with the first layer 102, the second layer 103 and the third layer 104 having the lower layer region 105 and the upper layer region was formed on an Al cylinder under the conditions shown in Table 2 using the fabrication apparatus shown in FIG. 2.

In Table 2, First layer and Second layer correspond the first layer 102 and the second layer 103 respectively. And, Third layer and Fourth layer correspond the lower layer region 105 and the upper layer region 106 respectively. The same situation as this is employed in Examples 2 through 4 also.

The thus obtained light receiving member was applied positive corona discharge with a power source voltage of 5.0 KV for 0.2 second, and soon after this, the image exposure was conducted by irradiating an exposure quantity of 15 lux.sec through a transparent test chart using a tungsten lamp as a light source. Then, the image was developed with a negatively charged toner (containing a toner and a toner carrier) in accordance with the cascade method to develop an excellent toner image on the member surface.

The developed image was transferred to a transfer paper by applying positive corona discharge with a power source voltage of 5.0 KV and then fixed so that an extremely sharp image with a high resolution was obtained.

Figure 3:
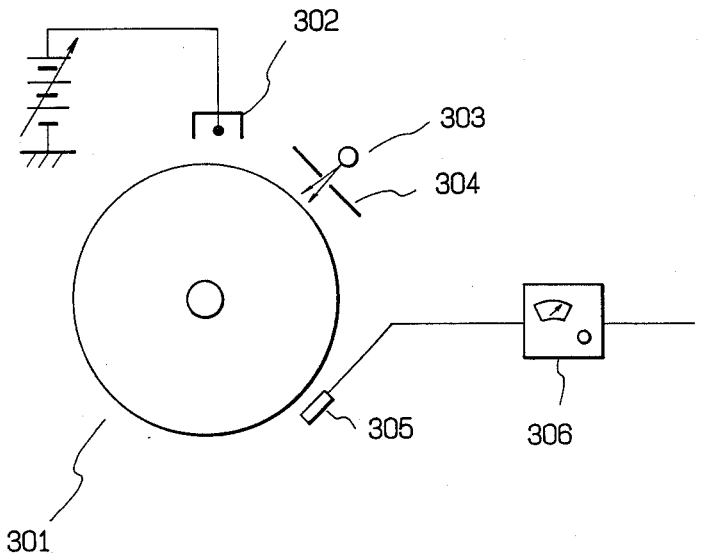
FIG. 3 is a schematic explanatory view of a device for measuring the electrification function and the residual voltage of a light receiving member.

Further, when electrification ability and residual voltage were measured on the light receiving member using a measuring device as shown in FIG. 3, there were 32 V/$\mu$ for the electrification ability and 5 V for the residual voltage.

In FIG. 3, there are shown a light receiving member 301, corona discharging means 302, exposing light source 303, slit 304, probe 305 and electrometer 306.

Further in addition, any change was not observed in both the electrification and the exposure characteristics, and occurrence of any image defect was not observed even after repeated twenty thousand times durability tests.

TABLE 1

| No. | $SiH_4$ Flow rate (SCCM) | $C_2H_4$ Flow rate (SCCM) | Discharging power (W/cm$^3$) | Temperature of substrate (°C.) | ESR (spins/cm$^3$) | $\rho$ ($\Omega \cdot$ cm) |
|---|---|---|---|---|---|---|
| A | 6 | 600 | 0.09 | 250 | $3.3 \times 10^{18}$ | $9.2 \times 10^{13}$ |
| B | 6 | 600 | 0.18 | 250 | $6.2 \times 10^{18}$ | $6.0 \times 10^{13}$ |
| C | 10 | 600 | 0.27 | 250 | $8.3 \times 10^{19}$ | $8.0 \times 10^{13}$ |
| D | 20 | 600 | 0.18 | 250 | $9.0 \times 10^{18}$ | $2.0 \times 10^{13}$ |
| E | 20 | 600 | 0.27 | 250 | $4.0 \times 10^{19}$ | $6.2 \times 10^{12}$ |
| F | 20 | 600 | 0.54 | 250 | $1.2 \times 10^{20}$ | $3.0 \times 10^{12}$ |
| G | 30 | 600 | 0.27 | 250 | $5.1 \times 10^{18}$ | $8.0 \times 10^{11}$ |
| H | 30 | 900 | 0.27 | 250 | $8.0 \times 10^{18}$ | $1.2 \times 10^{12}$ |

TABLE 2

| | Gas used | Flow rate (SCCM) | Flow ratio | Discharging power (W/cm$^3$) | Layer thickness ($\mu$) |
|---|---|---|---|---|---|
| First layer | $SiH_4$<br>$H_2$<br>$B_2H_4/H_2 = 10^{-3}$ | $SiH_4 = 200$ | $SiH_4/H_2 = 1$<br>$B_2H_6/SiH_4 = 10^{-4}$ | 0.18 | 3 |
| Second layer | $SiH_4$<br>$H_2$ | $SiH_4 = 200$ | $SiH_4/H_2 = 1$ | 0.18 | 15 |
| Third layer | $SiH_4$<br>$CH_4$ | $SiH_4 = 6$ | $SiH_4/CH_4 = 10^{-2}$ | 0.09 | 0.1 |
| Fourth layer | $SiH_4$<br>$CH_4$ | $SiH_4 = 20$ | $SiH_4/CH_4 = 1/30$ | 0.27 | 0.3 |

EXAMPLE 2

A light receiving member was prepared with the same procedures as in Example 1, except that the layer forming conditions for Third layer and Fourth layer were selected from those shown in Table as shown in Table 3 using the fabrication apparatus shown in FIG. 2.

Evaluation was made on the resulting light receiving member in the same way as in Example 1.

The results were as shown in Table 4.

TABLE 3

| | 2-① | 2-② | 2-③ | 2-④ | 2-⑤ | 2-⑥ | 2-⑦ | 2-⑧ | 2-⑨ | 2-⑩ |
|---|---|---|---|---|---|---|---|---|---|---|
| Third layer | A | A | A | A | A | B | B | B | D | D |
| Fourth layer | G | F | B | C | D | C | D | E | E | F |

TABLE 4

| | 2-① | 2-② | 2-③ | 2-④ | 2-⑤ | 2-⑥ | 2-⑦ | 2-⑧ | 2-⑨ | 2-⑩ |
|---|---|---|---|---|---|---|---|---|---|---|
| Electrification (V/μ) | 30 | 32 | 37 | 34 | 33 | 33 | 30 | 31 | 20 | 19 |
| Residual voltage (V) | 0 | 0 | 60 | 5 | 0 | 5 | 5 | 10 | 0 | 0 |
| Evaluation | x (note) | x (note) | x | ⊙ | ⊙ | ○ | ○ | ○ | x | x (note) |

Note:
Image flow was observed in the cases (1), (2) and (10).
⊙ Very good
○ Acceptable for practical use
x Poor

EXAMPLE 3

The same procedures as in Example 1 were repeated, except that the layer thickness of Third layer and that of Fourth layer were changed as shown in Table 5, to obtain a light receiving member.

The results of evaluation on the resulting light receiving members were as shown in Table 6.

TABLE 5

| | 3-① | 3-② | 3-③ | 3-④ | 3-⑤ | 3-⑥ | 3-⑦ |
|---|---|---|---|---|---|---|---|
| Third layer | 0.4μ | 0.3μ | 0.2μ | 0.1μ | 0.05μ | 0.1μ | 0.1μ |
| Fourth layer | 0.3μ | 0.3μ | 0.3μ | 0.3μ | 0.3μ | 0.2μ | 0.05μ |

TABLE 6

| | 3-① | 3-② | 3-③ | 3-④ | 3-⑤ | 3-⑥ | 3-⑦ |
|---|---|---|---|---|---|---|---|
| Electrification (V/μ) | 38 | 35 | 32 | 32 | 23 | 32 | 32 |
| Residual voltage (V) | 70 | 50 | 30 | 5 | 0 | 0 | 0 |
| Image defect after 20 thousand times durability tests (number of image defect/cm²) | 0 | 0 | 0 | 0 | 0 | 0 | 2 |
| Evaluation | x | x | Δ | ⊙ | Δ | ○ | x |

⊙ Very good
○ good
Δ Applicable for practical use
x Poor

EXAMPLE 4

The same procedures as in Example 1 were repeated, except that First layer and Second layer were formed with the conditions shown in Table 7, to obtain a light receiving member.

Evaluation was made on the resulting light receiving member in the same way as in Example 1, except that negative corona discharge with a power source voltage of 5.0 KV for 0.2 sec was conducted. As a result, there was obtained an extremely sharp image. Even after 20 thousand times durability tests, any change was not observed in both the electrification and the exposure characteristics. And occurrence of any image defect was not observed.

The results of the measurements on the electrification ability and residual voltage for the light receiving member were as follows;

Electrification ability: 33 V/μ

Residual voltage: 5 V

TABLE 7

| | Gas used | Flow rate (SCCM) | Flow ratio |
|---|---|---|---|
| First layer | $SiH_4$<br>$H_2$<br>$PH_3/H_2 = 10^{-3}$ | $SiH_4 = 200$ | $SiH_4/H_2 = 1$<br>$PH_3/SiH_4 = 5 \times 10^{-5}$ |
| Second layer | $SiH_4$<br>$H_2$ | $SiH_4 = 200$ | $SiH_4/H_2 = 1$ |

| | Discharge-ing power (W/cm³) | Layer thickness(μ) |
|---|---|---|
| First layer | 0.18 | 3 |
| Second layer | 0.36 | 20 |

What we claim is:

1. An improved light receiving member comprising a substrate for electrophotography and a light receiving layer being formed of a first layer composed of an amorphous material containing silicon atoms as the main component and an element for controlling the conductivity, a second layer having a photoconductivity composed of an amorphous material containing silicon atoms as the main component and a third layer comprising a two-layer structure having an amorphous silicon carbide lower layer region of 0.05 to 0.2 μm in thickness with a defect density of less than $8 \times 10^{18}$ cm$^{-3}$ (ESR signal) and an amorphous silicon carbide upper layer region with a defect density of more than $8 \times 10^{18}$ cm$^{-3}$ (ESR signal) and a volume resistivity of more than $5 \times 10^{12}$ Ω.cm.

2. A light receiving member for use in electrophotography according to claim 1 wherein the second layer is of a thickness of 1 to 100 μm and contains hydrogen atoms in an amount of 0.01 to 40 atomic %.

3. A light receiving member for use in electrophotography according to claim 1 wherein the second layer is of a thickness of 1 to 100 μm and contains halogen atoms in an amount of 0.01 to 40 atomic %.

4. A light receiving member for use in electrophotography according to claim 1 wherein the second layer is of a thickness of 1 to 100 μm and contains both hydrogen atoms and halogen atoms in a total amount of 0.01 to 40 atomic %.

5. A light receiving member for use in electrophotography comprising a substrate and a light receiving layer disposed on said substrate which is constituted by:

(a) a first layer to function as a charge injection inhibition layer which comprises amorphous material containing silicon atoms as the main constituent, a conductivity controlling element selected from Group III elements and Group V elements of the Periodic Table, and hydrogen atoms;

(b) a second layer to function as a photoconductive layer which comprises amorphous material containing silicon atoms as the main constituent and at least one kind selected from hydrogen atoms and halogen atoms; and (c) a two-layer structured third layer to function as a surface layer which is constituted by a 0.05 to 2 μm thick lower layer region comprising amorphous silicon carbide, said lower layer region having a defect density of less than $8\times10^{18}$ $cm^{-3}$ (ESR signal) and an upper layer region comprising amorphous silicon carbide, said upper layer region having a defect density of more than $8\times10^{18}$ $cm^{-3}$ (ESR signal) and a volume resistivity of more than $5\times10^{12}$ Ω.cm.

6. A light receiving member for use in electrophotography according to claim 5 wherein the first layer is of a thickness of 30 to 1000 Å and contains 30 to $5\times10^4$ atomic ppm of the conductivity controlling element and 0.01 to 40 atomic % of the hydrogen atoms.

7. A light receiving member for use in electrophotography comprising a substrate and a light receiving layer disposed on said substrate which is constituted by:

(a) a 30 to 1000 Å thick first layer to function as a charge injection inhibition layer which is composed of amorphous material containing silicon atoms as the main constituent, a conductivity controlling element selected from Group III elements and Group V elements of the Periodic Table in an amount of 30 to $5\times10^4$ atomic ppm, and hydrogen atoms in an amount of 0.01 to 40 atomic %;

(b) a 1 to 1000 Å thick second layer to function as a photoconductive layer which is composed of amorphous material containing silicon atoms as the main constituent and hydrogen atoms in an amount of 0.01 to 40 atomic %; and (c) a two-layer structured third layer to function as a surface layer which is constituted by a lower layer region and an upper layer region, said lower layer region being 0.05 to 0.2 μm thick, being composed of amorphous silicon carbide containing 0.001 to 90 atomic % of carbon atoms and having a defect density of less than $8\times10^{18}$ $cm^{-3}$ (ESR signal), and said upper layer region being composed of amorphous silicon carbide containing 0.001 to 90 atomic % of carbon atoms and having a defect density of more than $8\times10^{18}$ $cm^{-3}$ (ESR signal) and a volume resistivity of more than $5\times10^{12}$ Ω.cm.

8. An electrophotographic process comprising:

(1) applying a charge to the light receiving member of claim 1 or claim 7; and (2) applying an electric field to said light receiving member thereby forming an electrostatic image.

* * * * *

UNITED STATES PATENT AND TRADEMARK OFFICE

CERTIFICATE OF CORRECTION

PATENT NO. : 4,775,606

DATED : October 4, 1988

INVENTOR(S) : SHIGERU SHIRAI

It is certified that error appears in the above-identified patent and that said Letters Patent is hereby corrected as shown below:

COLUMN 3

Line 36, "forcusing" should read --focusing--.

COLUMN 5

Line 2, "Ti Pt" should read --Ti, Pt--.

COLUMN 6

Line 67, "the" should read --The--.

COLUMN 10

Line 56, "$C_{3\ H6}$)" should read -- ($C_3H_6$) --.

COLUMN 16

Line 49, "What we claim is:" should read --What is claimed is:--.

UNITED STATES PATENT AND TRADEMARK OFFICE

CERTIFICATE OF CORRECTION

PATENT NO. : 4,775,606

DATED : October 4, 1988

INVENTOR(S) : SHIGERU SHIRAI

It is certified that error appears in the above-identified patent and that said Letters Patent is hereby corrected as shown below:

COLUMN 18

Line 16, "1 to 1000Å" should read --1 to 100 μm--.

Signed and Sealed this

Twenty-first Day of November, 1989

*Attest:*

JEFFREY M. SAMUELS

*Attesting Officer*

*Acting Commissioner of Patents and Trademarks*